United States Patent [19]

Young et al.

[11] Patent Number: 4,828,127

[45] Date of Patent: May 9, 1989

[54] TAMPER-EVIDENT CLOSURES

[75] Inventors: David F. Young; Michael J. Wortley, both of Portsmouth, Great Britain

[73] Assignee: Cope Allman Plastics Limited, Farlington, England

[21] Appl. No.: 160,516

[22] Filed: Feb. 26, 1988

[30] Foreign Application Priority Data

Mar. 4, 1987 [GB] United Kingdom ..... 8705040

[51] Int. Cl.[4] ..... B65D 41/34

[52] U.S. Cl. ..... 215/252

[58] Field of Search ..... 215/252

[56] References Cited

U.S. PATENT DOCUMENTS 3,455,478 7/1969 Fields et al. ..... 215/252
4,529,096 7/1985 Chartier et al. ..... 215/252
4,541,536 9/1985 Davis et al. ..... 215/252
4,715,506 12/1987 McLaren ..... 215/252

*Primary Examiner*—Donald F. Norton
*Attorney, Agent, or Firm*—Irvin L. Groh; Alfred L. Patmore, Jr.

[57] ABSTRACT

In a tamper-evident screw-threaded closure of the kind in which the skirt of a cap is joined at its lower edge to a band by integral elongated breakable webs the webs are associated with co-operating teeth and notches that drive the band during the screwing-on step, the web extending from the root of the tooth to the adjacent wall of the notch in an inclined direction such as to flex or pivot and allow relative movement between the cap and band during this step without breaking, and the band has lugs which oppose circumferential, rather than axial, movement in the unscrewing direction.

4 Claims, 2 Drawing Sheets

TAMPER-EVIDENT CLOSURES

The invention relates to tamper-evident closures for containers. In recent years, and in particular following a tragic case in the U.S.A. a few years ago where the contents of container of a pharmaceutical product were adulterated with evil motives, it has become increasingly desirable, and indeed necessary, to provide such containers with sealed closures which cannot be opened and then re-closed without the fact being apparent to a subsequent user. Even with non-pharmaceutical products it is desirable to prove to purchasers that the goods he is buying have not been tampered with before sale.

Many such closures have been proposed, almost all of them involving some kind of web or webs which break when the closure is first removed. The problem lies not only in arranging that the webs should break reliably and inevitably when intended, but also in designing the closure so as to be easy to fit to the container, preferably by automatic machinery, and in designing the closure so as to be easy to fit to the container, preferably by automatic machinery, and in particular without involving any delicate or additional steps, such as swaging or welding or heat-sealing. A further problem lies in making the closure assembly easy to mould and in particular to strip from the mould after forming i.e. preferably to be able to mould it in a two-part tool substantially free of undercuts.

A typical example of a screw-threaded closure designed with these points in mind is shown in European Patent Application No. 0110709, in which a separate skirt on an internally threaded cap is joined integrally by thin breakable webs to a band which engages under an annular bead formed on the neck of the container below the external screw thread on the latter. When the cap is first screwed onto the container the band expands sufficiently to snap over the bead on the neck of the container, the profile of inside of the band and of the bead being appropriate to assist this, that is to say, being of saw-tooth shape in cross-section.

Because of the frictional load imposed on the band by this screwing on action, a load which would be too much for the relatively fragile webs, there are interengaging teeth on the lower rim of the skirt of the cap and on the upper edge of the band; these teeth came into mutual contact to transmit the screwing-on torque from the cap to the band, that is to say, to "drive" the band during the capping operation.

A similar construction is disclosed in a German Patent Application No. 1 955047, published in 1971. Again the inside of the band has a saw-tooth profile to allow it to pass over the bead on the neck of the container when the cap is first applied but to resist upward movement of the band when the cap is first unscrewed. Again there are interengaging driving teeth between the skirt of the cap and the tamper-evident band to act as drivers on first fitting of the cap, relieving the breakable webs of the driving torque. In one version these teeth are of saw-tooth profile as viewed radially, so that when the cap is unscrewed and the webs are broken the cooperating inclined surfaces of the teeth assist in forcing the cap upwards away from the band.

A still further example of a tamper-evident cap with breakable webs is that shown in U.S. Pat. No. 3,455,478 of M. R. Fields et al. Here again, the problem to be solved is that of avoiding premature breakage of the webs during capping. In this proposal there are no driving teeth or lugs but the webs are arranged in an inclined position, being inclined in such a direction that they are subjected to compressive forces, which they are able to withstand, by the clockwise rotation during capping but are subjected to tensile forces, which break them, when the cap is unscrewed. In this proposal, as in the other two described above, a bead in the tamper-evident band engages under a downwardly-facing bead on the neck of the container, over which it has sprung during capping, to resist axial upward movement of the band when the cap is unscrewed, i.e. without resisting circumferential movement per se.

With the known arrangements there is still the danger that a determined and careful tamperer can lever the cap and band off together without breaking the webs. This is partly because the cap has to be of material which is sufficiently flexible to allow the band to stretch and pass over the bead on the neck of the container on first assembly. It is also attributable to the fact that in practice it is difficult to make either the bead on the inside of the band or the bead on the neck of the container truly sharp and square in profile; more often than not they are both of appreciably rounded shape, and so one can be forced one over the other also in the releasing direction.

The aim of the invention is to overcome these drawbacks and to provide a tamper-evident screw-threaded closure assembly of the kind described which is easy to apply using existing automatic machinery, and without the webs being inadvertently broken during the capping step, yet is almost impossible to remove without breaking the webs.

According to the invention this is achieved in that the tamper-evident band does not rely on a bead that resists upward movement but on circumferentially spaced detents that resist rotation, and furthermore the webs extend in inclined directions between the roots of the teeth on the band and opposing inclined faces in the lower edge of the skirt of the cap. Alternatively they could extend between the roots of teeth of the cap and inclined faces on the upper rim of the band.

By having detents which resist rotation of the band we ensure that the webs are broken positively as soon as the user starts to unscrew the cap, as there is a direct circumferential load on the webs, and no reliance is place on resisting upward movement of the band. In practice there may be at least a vestigial bead on the neck of the container, but this is merely to prevent the band falling off after cap has been removed.

The use of inclined webs extending between the roots of the teeth and opposed inclined surfaces has particular advantages which will be explained in more detail below.

An example of a closure assembly according to the invention is illustrated by way of example in the accompanying drawings, in which.

Figure 8:
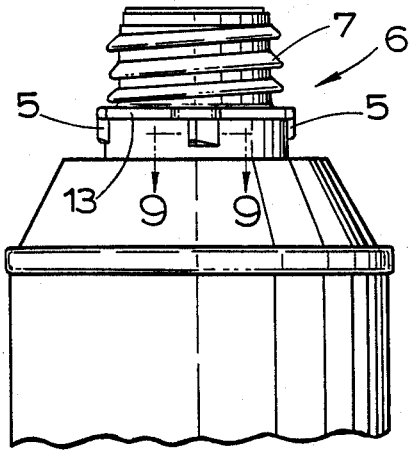
FIG. 8 is a side view of the neck and upper part of the container.
Figure 9:
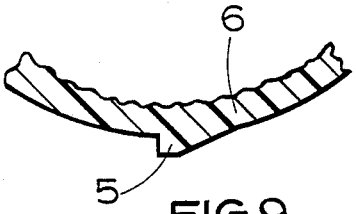
FIG. 9 is a cross section on the line 9—9 in FIG. 8, but to a larger scale.

The closure comprises an internally screw-threaded cap 1 with a cylindrical skirt 2, integral with a tamper-resistant band 3. The band has four circumferentially spaced internal lugs or detents 4 of saw-profile in plan view, co-operating with similarly shaped external lugs 5 on the neck 6 of the container (see FIGS. 8 and 9) below its screw thread 7.

Figure 1:
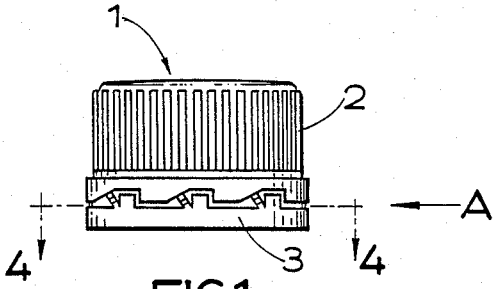
FIG. 1 is a side view of the closure, comprising the cap and integral tamper-evident band.
Figure 2:
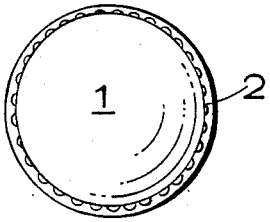
FIG. 2 is a plan view of the closure.

The lower edge of the skirt 2 of the cap has four or six, or any suitable number of notches 8, each of which is square at one end 9 and has an inclined face 10 at the other end. Projecting into these notches, but spaced a small distance from them, are castellations or teeth 11 on the upper edge of the band 3; these teeth are of square profile at both ends but there is, extending from the left-hand end (as viewed in FIG. 1) of the base of each tooth in an inclined direction, an integral breakable connecting web 12, joined at its other end to an intermediate point in the length of the inclined face of the associated notch in the cap.

Figure 5:
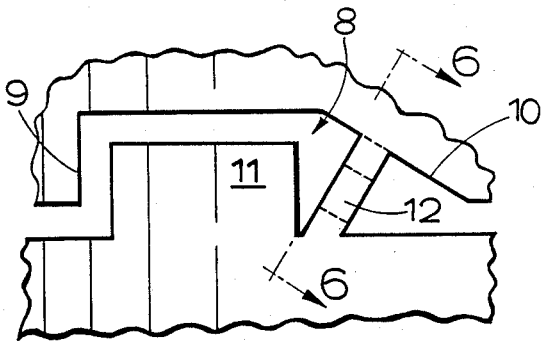
FIG. 5 is a detail view to a much larger scale, showing one of the driving teeth and one of the breakable webs, viewed from inside the closure;.

Although there is a small clearance between the right-hand end of each tooth 11 and the adjacent wall 9 of the associated notch 8 in the cap, this clearance is taken up when the cap is screwed onto a container, so that the torque is transmitted directly through these inter-engaging faces, and the webs 12 flex sufficiently to allow this to happen without breaking. Effectively, the webs 12 pivot about their base ends, i.e. the ends joined to the roots of the teeth 11, in a clockwise direction as viewed in FIG. 5, so as to bring the face 9 into contact with the left-hand end of the tooth 11 for applying a rotational drive to the band 3 and at the same time moving the cap downwards in relation to the band, so that the lower edge of the skirt of the cap may even come into direct contact with the top of the band, so that the axial driving force, as well as the circumferential driving force, is transmitted directly form the cap to the band without stressing the webs. In practice, however, because the band does not have to be forced over a major bead during capping, the axial force is low and so this axial contact will not generally occur.

As the closure assembly is screwed onto the container in a clockwise direction the lugs 4 ride over the lugs 5 moulded around the neck of the container but when an attempt is made to unscrew the cap the radial faces of the sets of lugs come into mutual engagement, positively preventing rotation of the band 3 and so the webs 12 break, allowing the cap alone to be unscrewed. This is assisted by the inclined faces 10 of the notches 8 riding up the adjacent corners of the castellations or teeth 11 and giving the cap an upward impetus.

There is a small annular bead 13 on the neck of the container but this is only for the purpose of preventing the loose band 3 falling off and it is in no way relied upon to hold the band down sufficiently to break the webs; the function of breaking the webs is that of the co-operating lugs 4 and 5.

It will be noted that there is no inward annular bead on the closure assembly, only the lugs 4, and so moulding in a tool with only a single split is an easy matter, and stripping from the mould is also easy, as even the lugs 4 can have rounded or inclined upper faces without detracting from their effectiveness.

Figure 3:
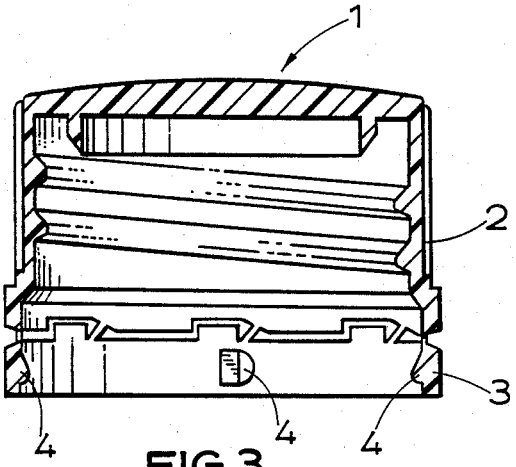
FIG. 3 is a vertical diametral section through the closure to a larger scale.
Figure 4:
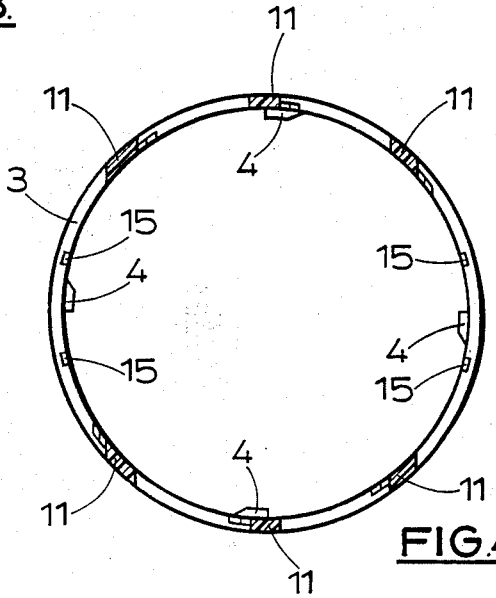
FIG. 4 is a section on the line 4—4 in FIG. 1.
Figure 7:
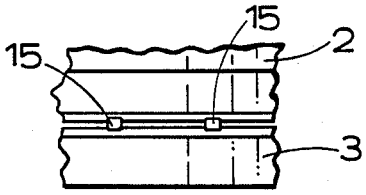
FIG. 7 is a detail view of a region of the closure looking in the direction of the arrow A in FIG. 1, but to a larger scale.

The six notches 8 and teeth 11 are not spaced evenly around the circumference of the cap; instead as shown in FIG. 4, they are in two groups of three with a substantial circumferential distance between the groups. this is simply in the interests of easy moulding, as then the cores which form the outline of them can be withdrawn in only two opposed directions, parallel to a radius through the centre tooth of the group instead of six radial directions. In the example shown there are, circumferentially spaced at points between the groups of teeth, two pairs of small connecting bridges 15, visible in FIGS. 3,4 and 7, joining the skirt 2 and band 3 independently of the webs 12. These bridges help to locate the band in relation to the cap during transport and handling, and they will normally become broken during the capping process but at this stage they have no function and so whether or not they are broken is unimportant.

Figure 6:
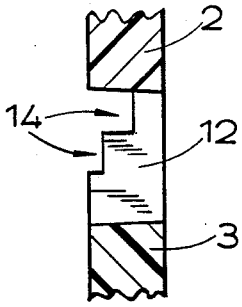
FIG. 6 is a section on the line 6—6 of FIG. 5.

The connecting webs 12 may be of uniform cross-section from top to bottom, but preferably have reduced upper ends so that they break preferentially at those ends, thereby leaving the cap clean and free from projections. FIG. 6 indicates how the cross-section of the webs is reduced by steps 14 towards their upper ends.

It will be appreciated the inclination of the webs in a direction contrary to that of the screw threads gives an upward impetus to the cap as it is unscrewed, further assisting the movement. Also, when the cap is first applied, this inclination correspondingly acts to pull the cap down onto the band to take up the clearance quickly and free the webs of further load, and the web is able to stretch and flex in doing this, with little chance of it breaking. This is in contrast to a horizontal web, which would tend to break under the screwing-on torque before the driving surfaces had come into mutual engagement.

On first unscrewing of the cap, by contrast, the inclined face 10 will have a shearing action, tending to break the web 12 against the tooth 11, as a consequence of the relative dispositions of the face 10, the web 12 and the left-hand end of the tooth 11.

We claim:

1. A tamper-evident closure for containers, said closure comprising a cap having a top wall and a depending skirt and an internal screw thread, the lower edge of said skirt being joined to an integral detachable tamper-evident band by a plurality of circumferentially spaced breakable elongated straight webs, and co-operating driving tooth surfaces on said skirt and band which come into mutual contact when said closure is screwed onto the neck of a co-operating container, wherein said driving surfaces are those of teeth each of said teeth having a driving face and a root opposite said driving face on one of said band and said skirt projecting into notches each of said notches having a driving face, a top wall and an inclined face opposite said driving face in the other of said skirt and said band and each web extends in an inclined direction between said root of one of said teeth and said inclined wall of an associated said notch, the inclination of said web being in such a direction that in the screwing-on step said web can flex to allow said driving face of said associated notch to be engaged by said adjacent driving face of said tooth and in which furthermore said band carries lugs provided with substantially radially extending faces designed to co-operate with corresponding lugs on the neck of the container so as to oppose circumferential rotation of said band in an unscrewing direction.

2. The closure set forth in claim 1 wherein the end of said web nearer to said inclined face of the notch is thinner than the other end thereof.

3. The closure set forth in claim 1 wherein each said web extends in a general direction inclined at substantially 45° to said lower edge of said skirt of said cap.

4. The closure set forth in claim 1 wherein each said tooth is of rectangular profile and said driving face and said top wall of said associated notch are at right angles and said inclined face of said notch is inclined away from said top wall.

* * * * *